United States Patent [19]

Phillips

[11] 4,005,676

[45] Feb. 1, 1977

[54] AIR KNIFE COATER TOP LIP SCRUBBER

[75] Inventor: Irvin J. Phillips, South Beloit, Ill.

[73] Assignee: Beloit Corporation, Beloit, Wis.

[22] Filed: May 22, 1972

[21] Appl. No.: 255,326

[52] U.S. Cl. ..... 118/63; 118/50; 118/249

[51] Int. Cl.[2] ..... B05C 11/06

[58] Field of Search ..... 118/63, 249, 50; 117/102 L; 15/306 A

[56] References Cited

UNITED STATES PATENTS

| | | | |
|---|---|---|---|
| 2,135,406 | 11/1938 | MacDonald | 118/63 X |
| 2,679,231 | 5/1954 | Pomper et al. | 118/63 |
| 2,733,653 | 2/1956 | Mullen | 118/63 X |
| 3,229,447 | 1/1966 | Kosta | 118/63 X |
| 3,336,899 | 8/1967 | Mahoney | 118/63 |
| 3,397,673 | 8/1968 | Mahoney et al. | 118/63 |
| 3,681,119 | 8/1972 | Reid et al. | 118/63 X |

*Primary Examiner*—John P. McIntosh
*Attorney, Agent, or Firm*—Hill, Gross, Simpson, Van Santen, Steadman, Chiara & Simpson

[57] ABSTRACT

A method and mechanism for applying a smooth layer of coating to the surface of a traveling web including a backup roll for carrying the web on its outer surface through a coating smoothing zone along the periphery of the roll, a coating applicator ahead of the zone including an applicator roll and a coating backing roll to form a pressure nip, an air knife at the smoothing zone directing a curtain of smoothing air against the oncoming web, a saveall in advance of the zone, for directing and an exhaust system downstream of the zone with a baffle to generate a cleansing flow of air to remove the airborne coating particles from the upper lip of the air knife.

4 Claims, 1 Drawing Figure

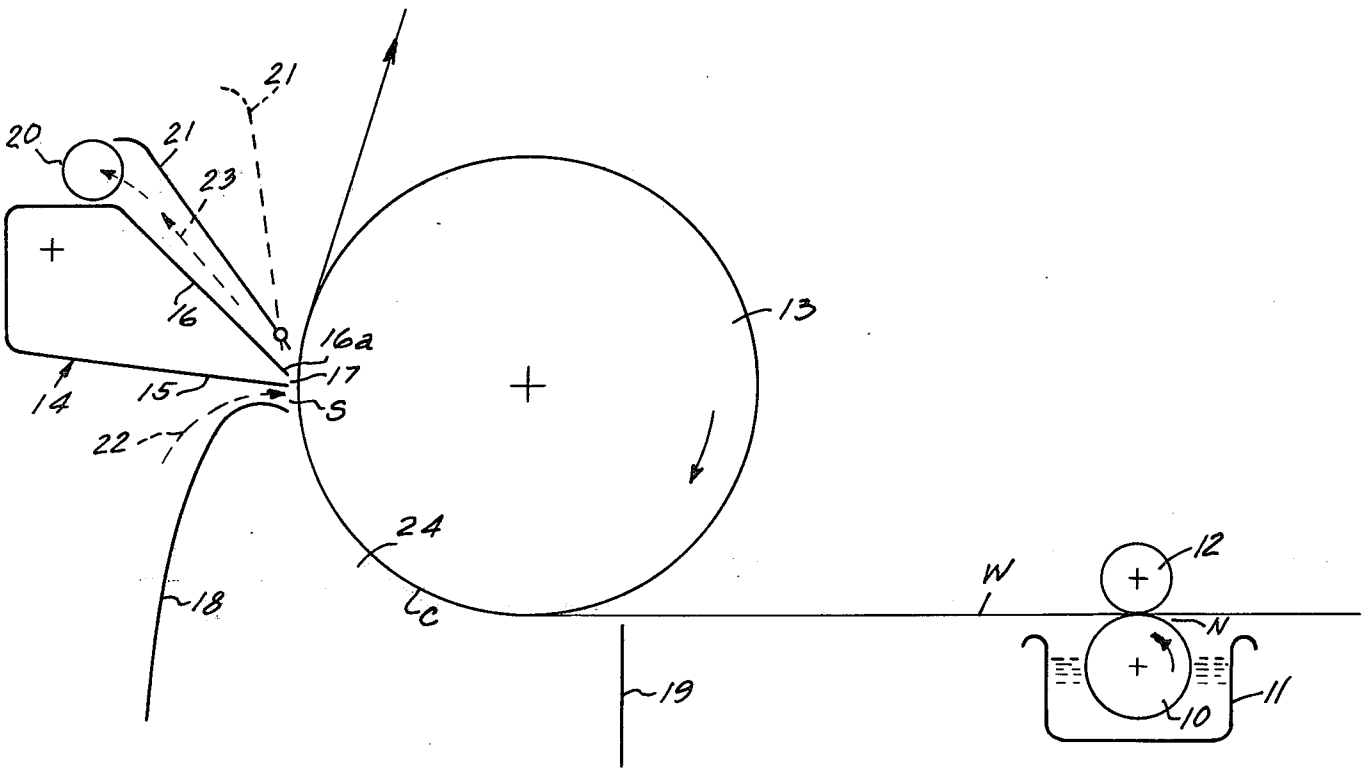
11
12
N
10
W
13
19
24
C
16a
17
S
21
23
21
16
15
22
18
20
14

AIR KNIFE COATER TOP LIP SCRUBBER

BACKGROUND OF THE INVENTION

The invention relates to improvements in traveling web coating mechanisms and more particularly to an improved air knife coater of the type used in paper web coating.

While the principles of the invention may be employed in coating various materials, the features are particularly well suited for use in coating a traveling paper web, and the preferred embodiment will be described in this environment. In air knife coating, a layer of coating is first applied to a traveling web, and the web is supported for stability on a backup roll with a curtain of relatively high velocity air directed against the oncoming web to smooth the coating surface and in some instances to doctor off excess coating. The velocity of air emitted from the air knife which is necessary for a satisfactory doctoring process and the speed of the oncoming web will tend to create a mist of particles of coating. The air knife coater includes a head with a pair of lips extending toward the smoothing zone where the curtain of air is emitted, and the entrained particles of mist which are formed in the zone tend to deposit on the lip of the coater, particularly on the downstream side of the smoothing zone. These particles will build up and require stopping the machine for cleaning. If they are not cleaned off, they will build up to a degree where they will fall off and cause surface defects in the moist coating, which condition cannot be condoned. The mist of airborne particles will increase as the speed of the coater increases and particularly with certain types of coating. In addition to depositing on the lip of the coater on the offrunning side, the particles of mist tend to become partially dried in the air and deposit on the coated web to cause imperfections. The mist, to some degree, will also coat surrounding machine parts, and is annoying and disadvantageous to personnel in other operations in the surrounding area. Attempts have heretofore been made to reduce the mist, but these devices have encountered difficulties and have not proven entirely successful.

It is accordingly an object of the present invention to provide an air knife coater embodying a method and arrangement for reducing and substantially eliminating the deposit of entrained coating mist particles which occurs on the downstream lip of the air knife coater.

A further object of the invention is to provide an air knife coater wherein there is not a continual deposit and build-up of coating particles on the air knife which require the nuisance and expense of stopping the machine.

A still further object of the invention is to provide an air knife coater wherein fine debris and coating dust that passes from the smoothing zone and is generated by impingement of the air jet on the coating is removed from the critical zones of operation and prevented from depositing on the machine.

A feature of the invention in the preferred embodiment employs a saveall below the smoothing zone of an air knife coater having a wall that projects toward the smoothing zone and is spaced from the air knife coater so that a flow of air can pass between the coating head and the wall. The structure also employs a baffle on the offrunning side of the smoothing zone, which baffle extends somewhat parallel to the upper, or downstream lip, of the coating head so that a flow of air continually passes along the downstream lip toward exhaust outlet passages carrying away entrained mist particles at a velocity preventing their deposition on the air knife lip or passing web.

Other objects, features and advantages of the invention will become more apparent with the teachings of the principles therof in connection with the disclosure of the preferred embodiments thereof, as will equivalent structures which are fully intended to be covered herein, in the specification, claims and drawings, in which:

DESCRIPTION OF THE DRAWINGS

The FIGURE of the drawing is a side elevational view in schematic form illustrating an air knife coating mechanism embodying the principles of the present invention.

DESCRIPTION OF THE PREFERRED EMBODIMENT

A traveling web W is received such as from a supply roll or from a paper making machine and passes through the unit shown in the drawing to be coated. Coating is applied to the underside of the web by an applicator roll 10 which picks up coating from a supply pan 11 extending axially along the length of the roll. Sufficient coating is provided in the pan so that coating carried up on the outer surface of the roll 10 into the nip N substantially floods the nip and provides a pressure application to the underside of the web W. A coating backing roll 12 is positioned at the upper side of the nip so that the coating will be applied with pressure to the web. The applicator roll 10 and the backing roll 12 may be driven at the speed of the web or the applicator roll 10 may be driven at a slightly higher speed than the web.

As the web W leaves the applicator roll 10, it has a layer of coating on its lower surface and is then wrapped over an arc of the surface of a backup roll 13. The backup roll is driven either from a separate source or due to contact with the web and has a smooth outer cylindrical surface to hold the web as the coating is being smoothed.

The coating mechanism illustrated is an air knife coater with an air knife head 14 constructed and arranged to direct a relatively high velocity jet of curtain of air against the surface of the oncoming coated web at a smoothing zone S. At the smoothing zone, the coating is smoothed, and in some circumstances, the air knife may be arranged to doctor off excess coating leaving the remaining coating with a smooth surface. Below the smoothing zone S is a saveall with walls 18 and 19 that receive excess coating blown downwardly by the air doctor 14.

The air doctor 14 has a chamber in which pressurized air is supplied and extends axially along the length of the backup roll 13. It is provided with a lower lip 15 and an upper lip 16 which lead to an air knife opening 17 through which the high velocity air flows to meet the oncoming coated traveling web to smooth the coating. The air curtain impinges against the web to smooth the coating, and the flow of air going counter to the traveling web will create a mist of air entrained coating particles. These coating particles, if left uncontrolled, will escape into the air to deposit on the still wet surface of the web and on surrounding machinery and more particularly, will deposit and build up on the lip 16 on the offrunning side of the smoothing zone S. If permitted to build up on this lip 16, this dust will eventually break off and fall onto the web to cause substantial defects in the coated web surface, and it has been necessary to periodically stop the machine to clean off these dust deposits on the lip. They can particularly build up just on the offrunning side of the distal edge 16a of the upper lip so that various small particles can become dislodged and mar the coated surface of the web.

To avoid this material from settling out on the top lip 16 of the air knife, a unique air flow control arrangement is provided which employs the method of directing a flow of air upwardly through the smoothing zone over the edge 16a of the upper lip and along its top surface away from the web to be collected by an exhaust outlet 20. The rear wall 18 of the saveall curves upwardly to extend relatively close to the smoothing zone so that the air which is emitted from the air doctor impinges on the coating and deflects downwardly into the saveall 24. However, a flow of cleansing air passes upwardly through the channel indicated by the broken arrowed line 22 between the lower lip 15 of the air doctor and the rear wall 18 of the saveall. This flow of air generally will be entrained by the jet of smoothing air emitted from the air doctor to pass downwardly into the saveall chamber 24.

Air with entrained particles which comes off the jet from the opening 17, or in other words, which is caused by a deflection or bounce off of the traveling web will flow upwardly in the path indicated generally by the broken arrowed line 23. This flow will be along the upper surface of the upper lip 16 at a velocity so that particles of mist entrained thereon will not deposit on the upper surface, and there will be sufficient flow away from the edge 16a of the upper lip to prevent dust particles from settling thereon. The air is confined to a flow in the path indicated by the broken arrowed line 23 by upper baffle 21 which leads upwardly to the exhaust outlet system 20 extending axially along the top of the air knife head.

The air doctor is pivotally adjustable to operate at an optimum smoothing angle. The angle is chosen to give the best doctoring effect, and the present invention makes it unnecessary to consider mist when setting the doctor angle because such mist is prevented from accumulating on the upper lip surface of the doctor.

For on the run inspection to determine the effectiveness of the air flow, the baffle 21 is pivoted about its lower edge to be movable to an inspection position shown by the broken line position 21. This inspection position also accommodates cleaning when such is done during normal shutdown periods. The exhaust outlets can be arranged as sheet metal ducting extending the length of the machine across the top of the air knife with exhaust fans at the end to carry away air with particles therein. The air may be exhausted into the atmosphere or passed into a centrifugal cleaner wherein the particles are removed.

It has been found that the arrangement above described will accommodate the relatively appreciable mist created from high speed operating mechanisms without permitting the mist to escape into the air or deposit on the upper lip of the air doctor. In commercial devices operating at 2000 feet per minute and greater, the mist can be appreciable and heretofore has resulted in the production of imperfectly coated paper or has required frequent shut-downs which are costly and inconvenient. In such machines with each shutdown, a length of paper is damaged and to restart the machine often requires complete cleaning out of the coating from the applicator which may tend to contain air dried lumps and particles.

Thus, it will be seen that I have provided an improved air knife coater with mist control which meets the objectives and advantages above set forth.

I claim as my invention:

1. A coating mechanism comprising in combination, a rotary backup roll for carrying a traveling web wrapped on its outer surface through a coating smoothing zone along the periphery of the roll, a coating applicator ahead of said zone applying liquid coating to the outer surface of the web, an air knife smoothing mechanism extending axially along the roll at said smoothing zone positioned for directing a stream of air toward the oncoming coated web for smoothing the coating, an air supply means ahead of the air knife for generating a cleansing flow of air over the air knife between the web and knife for carrying away airborne coating particles and preventing accumulation of said particles on the air knife, an exhaust outlet passage extending over the surface of the air knife on its downstream side from said zone relative to the direction of travel of the web and leading away from the web and including a baffle forming one wall of the passage with a downstream surface of the knife forming the other wall of said passage, the inner edge of said baffle adjacent the roll being spaced from the roll so that air flows between the web and inner edge of the baffle when entering said exhaust outlet passage, said passage receiving air from said air supply means after the air flows between the air knife and web and also receiving air from between the web and the inner edge of the baffle so that air flows in a direction away from the web following said coating smoothing zone, and a hinged support at said inner edge of the baffle pivotally mounting the baffle so that the baffle is pivotally movable about its inner edge away from said exhaust outlet passage for access to the passage and downstream surface of the knife for inspection and cleanup.

2. A coating mechanism constructed in accordance with claim 1 wherein said coating applicator includes a coating applicator roll, a container of coating open to said applicator roll and submerging a sufficient part of said applicator roll in coating to cause the applicator roll to carry coating up onto the web to form a submerged coating nip, a coating applicator backing roll opposite the applicator roll for supporting the web as coating is applied thereto.

3. A coating mechanism constructed in accordance with claim 1 and including a saveall upstream from said zone with a saveall wall extending toward the zone with the wall spaced from the air knife so that said cleansing flow of air passes between the wall and the air knife through said smoothing zone.

4. A coating mechanism constructed in accordance with claim 1:

wherein the mechanism includes an exhaust outlet extending axially along the air knife and positioned radially away from said zone for receiving air from said passage.

* * * * *